United States Patent [19]

Focke et al.

[11] Patent Number: 4,932,534

[45] Date of Patent: Jun. 12, 1990

[54] PACKAGE FOR A PLURALITY OF CIGARETTE PACKS OR THE LIKE

[75] Inventors: Heinz Focke, Verden; Bernhard Focke, Bremen, both of Fed. Rep. of Germany

[73] Assignee: Focke & Co., Verden, Fed. Rep. of Germany

[21] Appl. No.: 906,637

[22] Filed: Sep. 10, 1986

Related U.S. Application Data

[63] Continuation of Ser. No. 599,157, Apr. 11, 1984, abandoned.

[30] Foreign Application Priority Data

Apr. 14, 1983 [DE] Fed. Rep. of Germany ..... 3313462

[51] Int. Cl.[5] ..... B65D 5/54

[52] U.S. Cl. ..... 206/602; 206/273; 229/120.09

[58] Field of Search ..... 206/602, 273; 229/120.08, 120.09

[56] References Cited

U.S. PATENT DOCUMENTS

| | | | |
|---|---|---|---|
| 276,171 | 4/1883 | Fraser | 206/602 |
| 1,318,124 | 10/1919 | Wright | 206/602 |
| 1,863,190 | 6/1932 | Coulapides | 206/273 |
| 2,046,484 | 7/1936 | Ringler | 206/602 |
| 2,320,006 | 5/1943 | Moore | 229/120.09 |
| 2,873,058 | 2/1959 | Jansen | 229/120.09 |
| 3,048,321 | 8/1962 | Sanford | 206/602 |
| 3,071,244 | 1/1963 | Doran | 206/602 |
| 3,092,301 | 6/1963 | Selle | 206/602 |
| 3,135,457 | 6/1964 | Risucci . | |
| 3,142,378 | 7/1964 | Lengsfield, Jr. | 206/602 |
| 3,226,010 | 12/1965 | Rogers, Jr. | 206/602 |
| 3,241,738 | 3/1966 | Freiman . | |
| 3,341,103 | 9/1967 | May | 229/120.09 |
| 3,447,733 | 6/1969 | Smith et al. | 206/602 |
| 4,083,879 | 4/1978 | Capo | 206/602 |
| 4,294,353 | 10/1981 | Focke et al. . | |
| 4,377,237 | 3/1983 | Pawlowski | 206/602 |

FOREIGN PATENT DOCUMENTS

| | | | |
|---|---|---|---|
| 822225 | 11/1951 | Fed. Rep. of Germany . | |
| 1764166 | 3/1958 | Fed. Rep. of Germany . | |
| 7419126 | 5/1974 | Fed. Rep. of Germany . | |
| 353039 | 8/1905 | France | 229/120.08 |
| 49-12137 | 2/1974 | Japan . | |
| 49-31730 | 3/1974 | Japan . | |
| 55-115929 | 8/1980 | Japan . | |
| 739899 | 11/1955 | United Kingdom | 206/602 |

*Primary Examiner*—Stephen P. Gorbe

*Attorney, Agent, or Firm*—Burns, Doane, Swecker & Mathis

[57] ABSTRACT

Cigarette cartons are packages with a relatively large number (for example, ten) of cigarette packs (30). Because of a special design of this cigarette carton or of a common blank (33), it becomes possible to divide the cigarette carton to form part packs (half-cartons 34, 35), each of these part packs as well as the complete cigarette carton forming a saleable unit which is convenient to handle.

5 Claims, 10 Drawing Sheets

PACKAGE FOR A PLURALITY OF CIGARETTE PACKS OR THE LIKE

This application is a continuation of application Ser. No. 599,157 filed Apr. 11, 1984, now abandoned.

FIELD OF THE INVENTION consisting of paper, cardboard or the like.

BACKGROUND OF THE INVENTION

Cigarette cartons are relatively large packaging units for cigarette packs. Conventionally, ten cigarette packs are combined to form a large pack of this type which is wrapped by means of a paper or cardboard blank.

OBJECTS AND SUMMARY OF THE INVENTION

The object on which the invention is based is to develop further packages of the type mentioned in the introduction, in such a way that the packages are more convenient to handle, especially when they are on sale.

To achieve this object, the package according to the invention is characterised in that connected part packs, especially half-cartons, can be separated from the package.

Accordingly, the package (cigarette carton) according to the invention is basically constructed in a conventionaly way as regards its external appearance, and therefore has a customary cuboid shape with a number of cigarette packs, preferably ten, wrapped by means of a blank. The particular feature is that it is possible to divide up the package (cigarette carton), to obtain part packs each convenient to handle per se, so that a smaller unit, especially a "half-carton" can be distributed, displayed or sold.

The outer wrapping of the package preferably consists of a single one-piece blank.

This is designed so that in the region of one edge, especially a lateral longitudinal wall, a severing line is formed within the blank in the dividing plane, so that the two half-cartons can be separated here by being severed from one another.

Because a weakening of material, especially a perforation or the like, is provided at one of the edges of the longitudinal side walls, the package can be severed (manually) in a simple way by swinging the part packs onto one another and breaking the blank in the region of the severing line, the longitudinal side faces turned towards one another being supported against one another.

In a further exemplary embodiment of the package according to the invention, the longitudinal side of the half-cartons which faces the severing line or breaking line of the latter is open, in such a way that the end faces of the cigarette packs are exponsed here. It is thereby possible to execute manipulations on the end faces of the cigarette packs, especially to apply revenue stamps or revenue imprints.

BRIEF DESCRIPTION OF THE DRAWINGS

Further features of the invention relate to the constructive design of the package in various embodiments and to measures for producing and closing such packages. Exemplary embodiments are explained in more detail below with reference to the drawings in which like elements bear like reference numerals and where is.

DETAILED DESCRIPTION OF THE PREFERRED EMBODIMENTS

Figure 1:
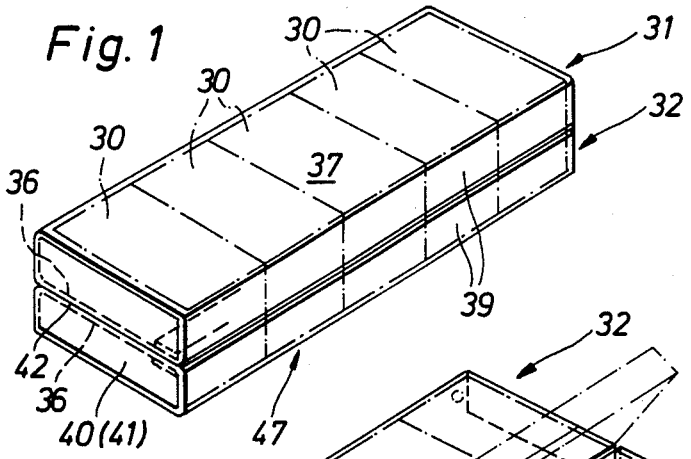
FIG. 1 shows a preferred exemplary embodiment of a cigarette carton in a perspective representation.
Figure 2:
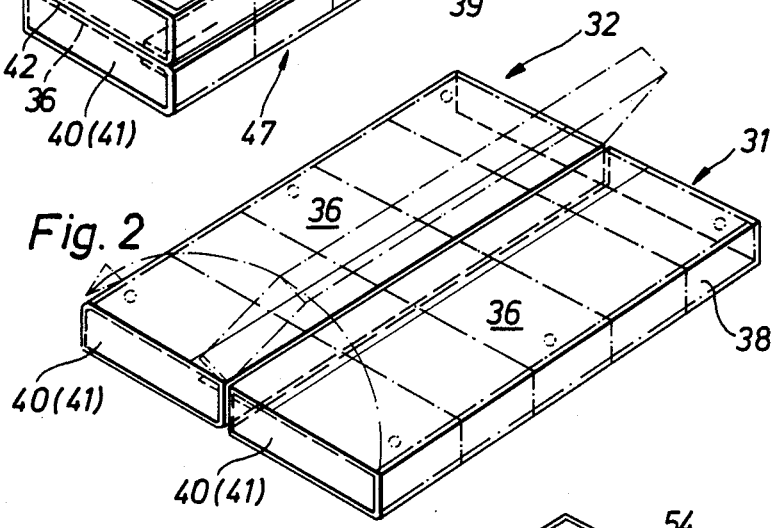
FIG. 2 shows the package according to FIG. 1 in an intermediate position during its production.

The exemplary embodiments of the invention which are illustrated in the drawings relate to the packaging of cigarettes. Several individual cigarette packs 30 are to be accommodated in a larger package, namely a cigarette carton. In each of the exemplary embodiments illustrated, ten cigarette packs 30 altogether are combined to form a cigarette carton. The cigarette packs 30 are grouped in two rows of packs 31 and 32, specifically in such a way that the cigarette packs 30 are oriented with their longitudinal extension transverse to the longitudinal direction of the cigarette carton. The cigarette packs 30 are arranged to lie flat within the rows of packs 31, 32.

Figure 8:
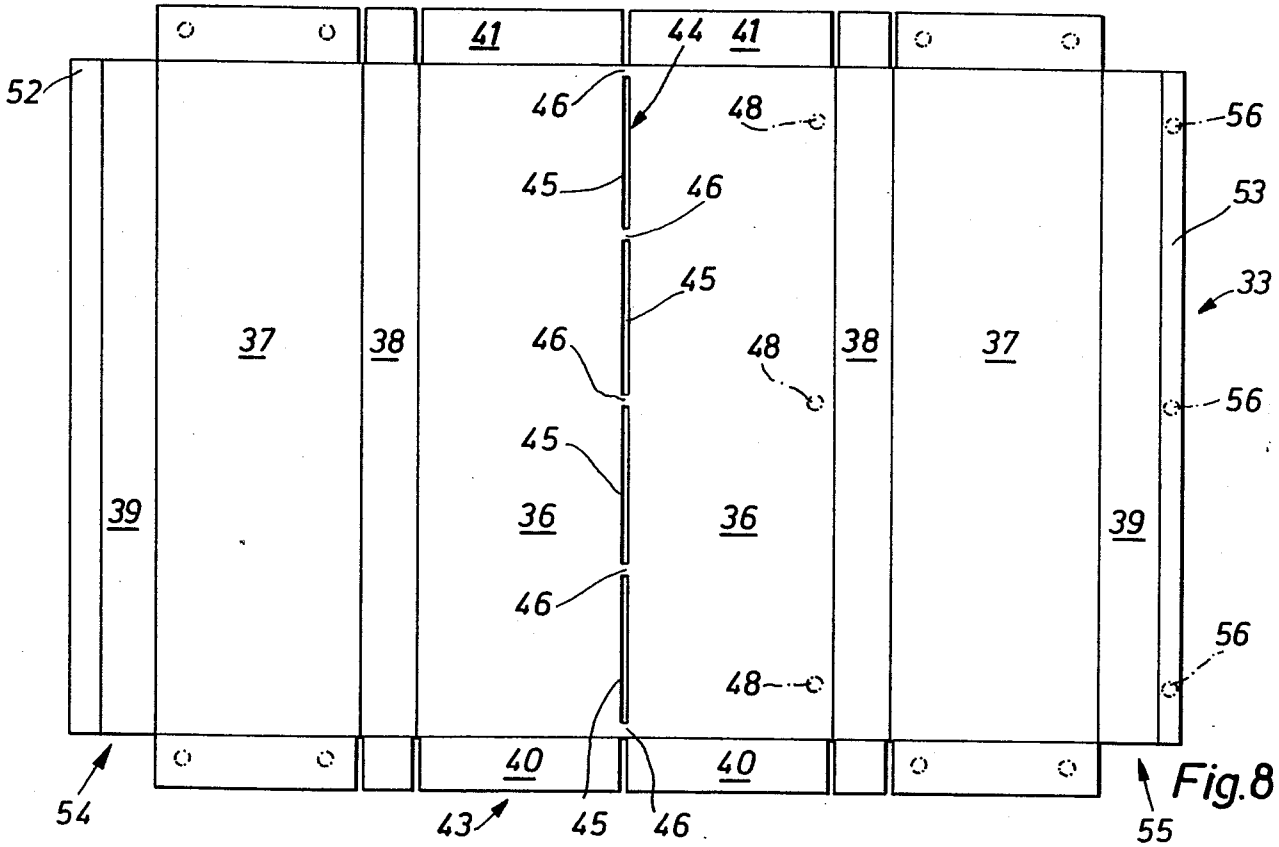
FIG. 8 shows a blank for a package according to FIGS. 1 to 7 in a spread-out state.

The group of ten cigarette packs 30 altogether is wrapped by means of a common blank 33 (Figure 8). This can consist of paper, cardboard or even a suitable foil or a laminate product. The blank 33 is designed and folded in such a way that the rows of packs 31 and 32, that is to say the entire pack content, are completely enclosed.

Furthermore, the wrapping is designed so that ech row of packs 31, 32 acquires a certain independence, such that part packs are obtained by severing or dividing the package, in the present case half-cartons 34 and 35 which accordingly each contain a row of packs 31 and 32 respectively (five cigarette packs 30). In the exemplary embodiment according to FIGS. 1 to 8, thes half-cartons 34, 35 ar completely enveloped all-round by means of covering walls 36, 37, longitudinal side walls 38 and 39 and end walls 40 and 41. The covering walls 36 constitute first covering walls while the covering walls 37 constitute second covering walls.

The common one-piece blank 33 (FIG. 8) is wrapped round the two rows of packs 31, 32 in such a way that when the package is complete the interconnected covering walls 36 of the two half-cartons 34 and 35 rest on one another (FIG. 1 and FIG. 4), specifically in the region of a dividing plane 42 for the package. The connection between the two covering walls 36 can be broken or severed. For this reason, a blank zone 43 forming the two covering walls 36 is provided centrally with a severing line 44 which consists sof a perforation or severing cuts 45 with residual connections 46. The so-formed blank zone 43 of the blank 33 connects the two half-cartons 34 and 35 to one another, and the severing line 44 extends centrally in the region of a side face 47, formed by the two longitudinal side walls 39, of the complete package.

Figure 3:
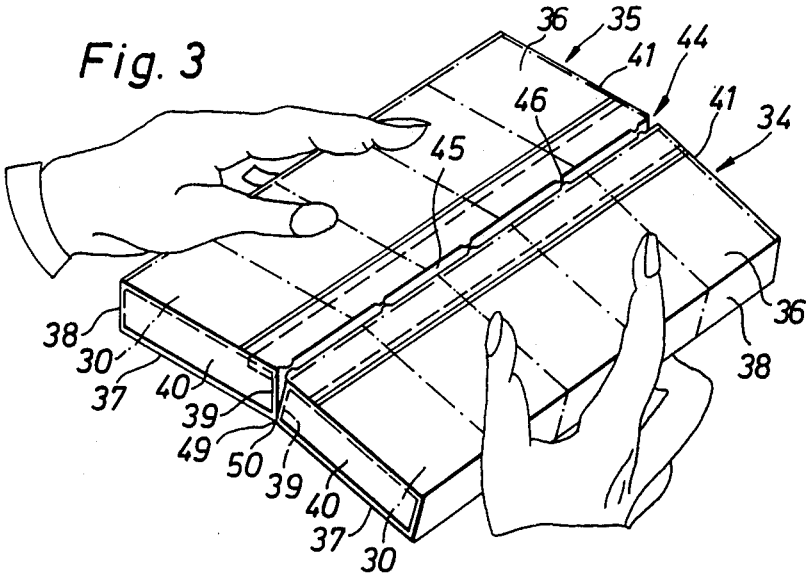
FIG. 3 shows the package according to FIGS. 1 and 2 when it is being divided.
Figure 5:
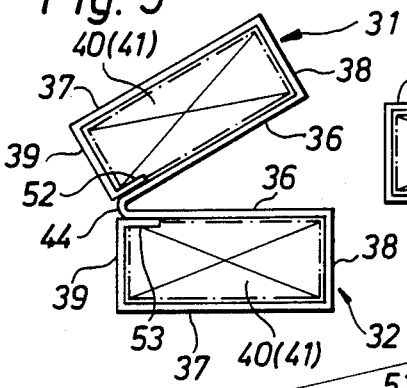
FIG. 5 shows the package in an end view during a phase of its production.
Figure 6:
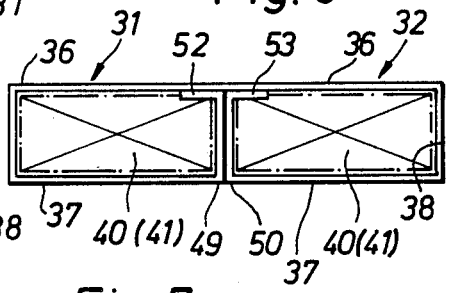
FIG. 6 shows an end view corresponding to the representation according to FIG. 3.
Figure 7:
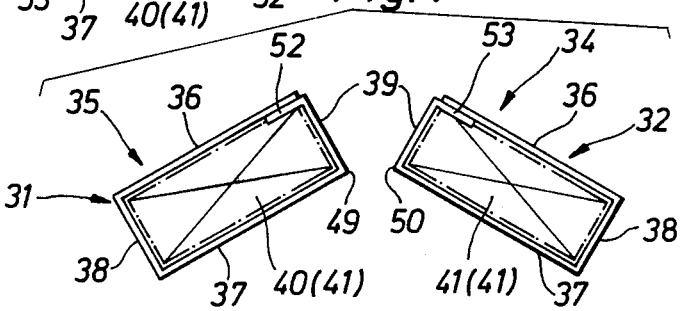
FIG. 7 shows an end view of the divided package consisting of two part packs.

In the present case, the complete cigarette carton (FIG. 1) is formed not only by connecting the half cartons 34 and 35 to one another in the region of the severing line 44 of the common blank 33, but also by means of further breakable connections, in the present case several spot-like glue points 48 which are provided, on the side of the half-carton 34, 35 which is remote from the severing line 44, on the covering walls 36, facing one another, of the two half-cartons 34, 35. As a result of these breakable connections, a stable package (cigarette carton) marketable as a single unit and essentially having a conventional appearance (FIG. 1) is obtained. Alternatively, it is possible to divide the cigarette carton to form the half cartons 34, 35. In this case, in the exemplary embodiment discussed here, the half-cartons 34, 35 must first be pivoted into a common plane (FIGS. 2 and 3) by breaking the glue points 48. the blank 33 can now be severed in the region of the severing line 44. In the present case, a particular breaking effect is utilised (FIG. 3). The two half-cartons 34, 35 are supported against one another by means of the longitudinal side walls 39 facing one another, and in particular supporting edges 49, 50, distant from the severing line 44, of the two half-carton 34, 35 facilitate the (manually executed) breaking effect via these supporting edges 49, 50.

The present package is designed to comply with particular revenue regulations such as those in force, for example, in the USA. The individual cigarette packs 30 are to be provided in the region of end faces 51 with a revenue stamp or an imprint after the cigarette carton has been (largely) completed. For this reason, a provisional closing position of the cigarette carton is first formed here, as is evident from FIG. 4 and FIG. 12.

The blank parts forming the common side face 47 (with the severing line 44) of the cigarette carton are, on the one hand, the (strip-shaped) longitudinal side walls 39 and, on the other hand, a connecting edge strip 52, 53 adjoining each of these. When the cigarette carton is completed, the latter are folded inwards and each lie between an edge region of the covering walls 36 and the wrapped cigarette packs 30. The connecting edge strips 52, 53 are joined to the associated covering wall 36 by means of glue spots.

Figure 4:
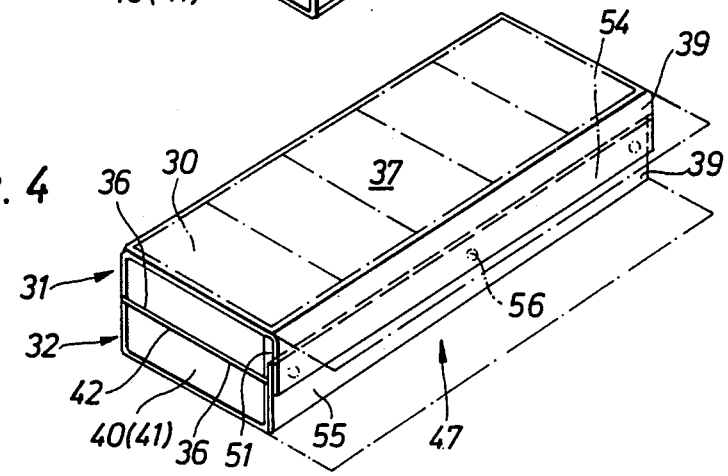
FIG. 4 shows the package according to FIGS. 1 to 3, in an intermediate closing position.
Figure 11:
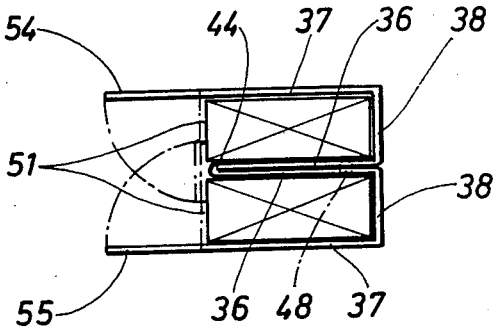
FIG. 11 shows an end view of the design of the package before the intermediate closing position is assumed.
Figure 12:
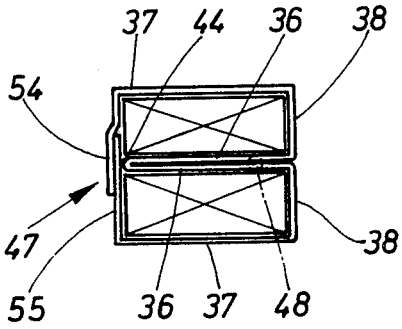
FIG. 12 shows an end view of the intermediate closing position.

The above-mentioned intermediate closing position according to FIG. 4 and FIG. 12 is such that lateral closing tabs 54 and 55, formed from the longitudinal side walls 39 and the adjoining connecting edge strips 52, 53, are connected releasably to one another whilst overlapping one another. For this purpose, glue spots 56 are provided on the connecting edge strip 53, and these ensure this releasalbe closure according to FIG. 12. To apply the revenue number or other markings on the end faces 51 of the cigarette packs 30, the lateral closing tabs 54, 55 are pivoted, the glue spots 56 being broken at the same time, into a position approximately according to FIG. 11 or as shown by dot-and-dash lines in FIG. 4, so that a suitable device can be brought up to the end faces 51.

After this measure, the final form of the cigarette carton according to FIG. 1 is produced, the connecting edge strips 52, 53 being folded inwards in the above-mentioned way.

Figure 9:
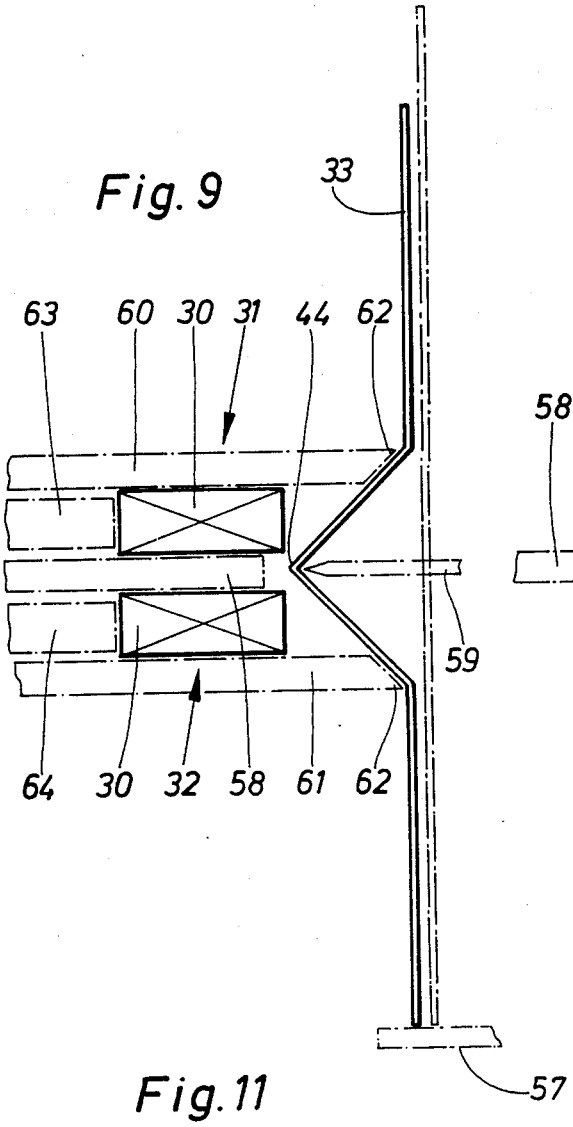
FIG. 9 shows in a diagrammatic end view, a phase during the production of a package using a blank according to FIG. 8.
Figure 10:
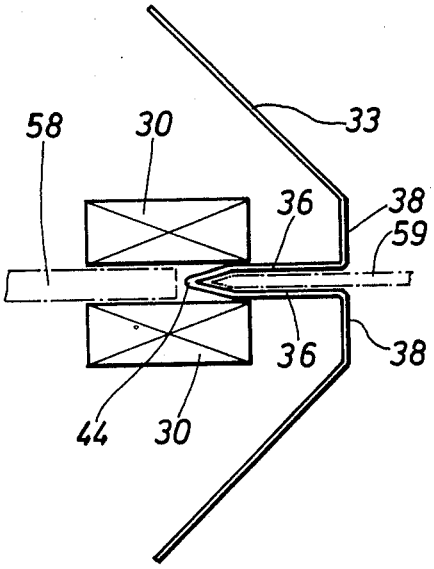
FIG. 10 shows a representation similar to FIG. 9 for a futher phase of production of the package.

In the production of the present packages (cigarette cartons) from a blan 33 according to FIG. 8, the procedure can, according to FIG. 9 and 10, be, for example, to sever the blank 33 from a continuous sheet and fix it in an upright position on a lower stop 57. The two rows of packs 31 and 32 are supplied in a horizontal plane perpendicularly to the drawing plane in relation to FIG. 9. The rows of packs 31 and 32 are retained at a distance from one another by an intermediate guide 58. by means of a folding blade 59 and by means of plate-shaped abutments 60 and 61 located above and below the rows of packs 31, 32, and having folding edges 62 ending obliquely or tapering to a point, the blank 33 is pre-folded approximately in the form of a V, the fold being located in the region of the severing line 44. In the continuing process, the part of the blank 33 forming the covering walls 36 and located between the rows of packs 31, 32 is folded (FIG. 10), and the intermediate guide 58 is retracted correspondingly a at the same time. The rows of cigarettes are supported laterally by abutments 63, 64. At the same time, the longitudinal side walls 38 in the blank 33 are pre-folded by further folding members not shown in detail, so that the rows of packs 31, 32 are covered at the top and bottom by blanks parts finally directed horizontally (FIGS. 10 and 11). When the provisional closing position according to FIG. 12 is assumed, the pack is consequently completed, the end walls 40, 41 being folded over in a suitable way by known folding members.

Figure 13:
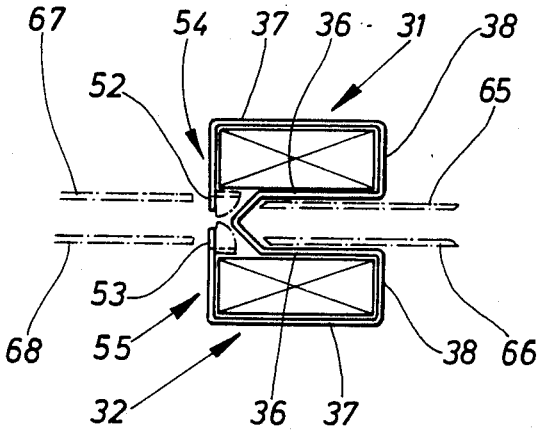
FIG. 13 shows a side view of the package at the completion stage after the intermediate closing position has been cancelled.
Figure 14:
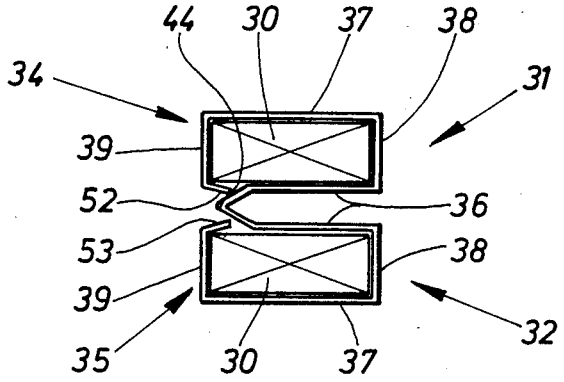
FIG. 14 shows a further production phase subsequent to that according to FIG. 13.
Figure 15:
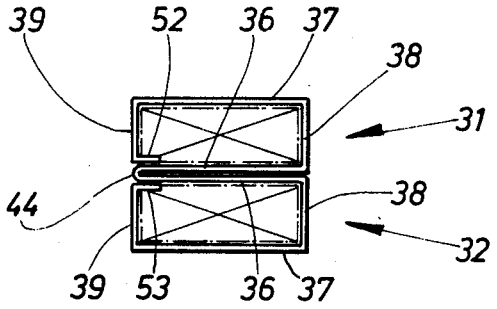
FIG. 15 shows the completion of the package for final consumption.
Figure 18:
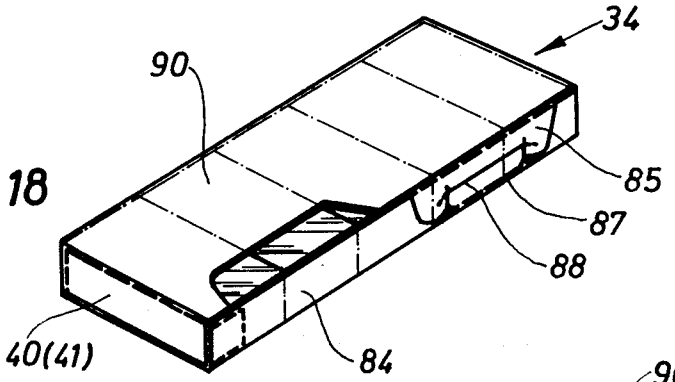
FIG. 18 shows a part pack related to FIGS. 16 and 17.
Figure 17:
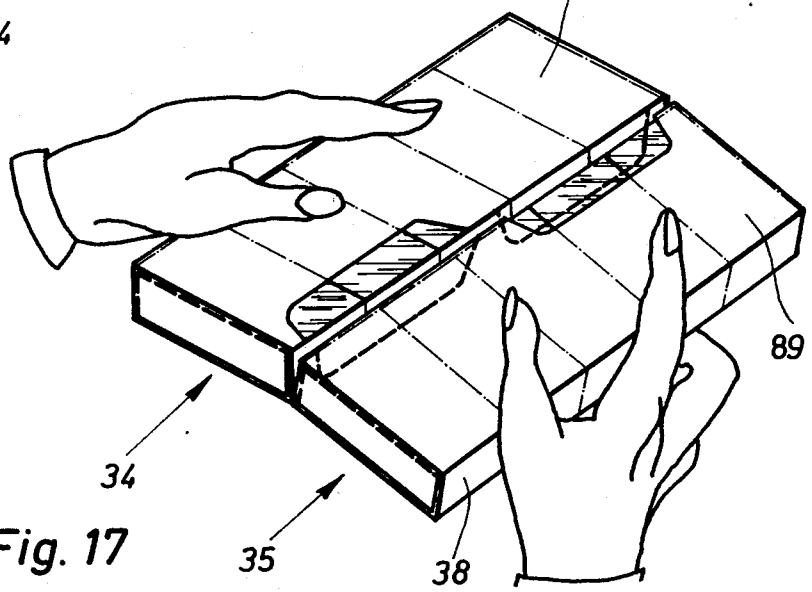
FIG. 17 shows the division of a package according to FIG. 16.
Figure 16:
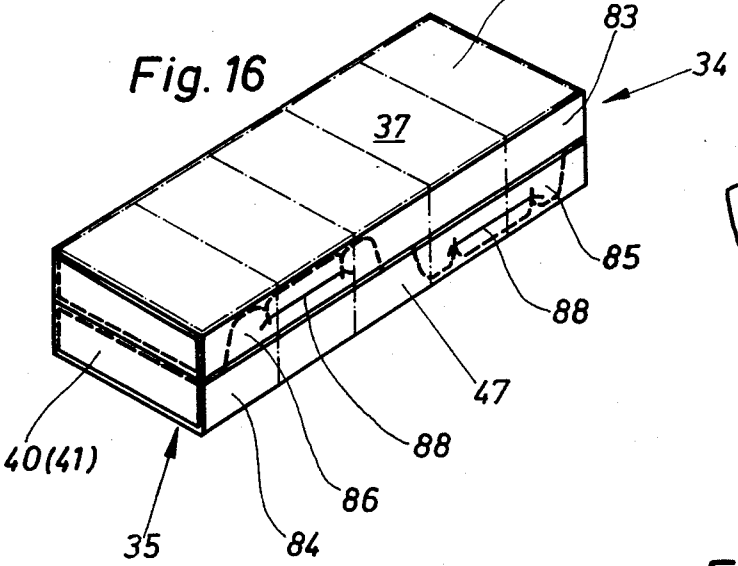
FIG. 16 shows a further exemplary embodiment of a package with a closing flap, in a perspective representation similar to FIG. 1.

To form the saleable design of the cigarette carton, the connection between the lateral closing tabs 54, 55 is broken again, as already mentioned. To fold the connecting edge strips 52, 53 into the final position, the row of packs 31, 32 (wrapped in the blank 33) are spaced apart from one anothr (FIG. 3) by means of appropriately designed and movable spreader strips 65 and 66. These also expose the edge regions, facing one another, of the cigarette packs 30, so that the connecting edge strips 52, 53 extending in a common lateral plane can be folded by associated folding tongues 67, 68 against the sides facing one another of the cigarette packs 30 (FIG. 13). After the spreader strips 65 and 66 and folding tongues 67, 68 have been retracted, the rows of packs 31 and 32 still located at a distance from one another are pressed together, that is to say moved towards one another, so that the above-described construction of the cigarette carton according to FIG. 15 is provided. At the same time, the covering walls 36 are connected to one another by means of the previously activated glue spots 48.

The embodiment of a cigarette carton according to FIG. 16 to FIG. 22 corresponds in its basic design and function to those already described. The cigarette carton (FIG. 16) is formed from a one-piece blank according to FIG. 19. A cigarette carton of essentially conventional shape with two half-cartons 34 and 35 is obtained.

The particular feature of this exemplary embodiment is that the longitudinal side walls 83 and 84, forming the common side face 47 of the cigarette carton 23, of the two half-cartons 34, 35 are designed in a special way. In particular, an insertion flap 85, 86 is assigned to each of them. The insertion flaps 85, 86 are lcoated at a distance from one another over the length of the longitudinal side walls 83, 84, that is to say are off-center. They are activated or are formed only when the cigarette carton (FIG. 16) is divided into the part packs (half-cartons 34, 35). The insertion flaps 85, 86 are then released and, by being folded over into the plane of the longitudinal side wall 83 or 84, can be introduced by means of a delimited insertion tongue 87 into a retaining slit 88 arranged at a suitable location in the longitudinal side wall 83 or 84.

The insertion flaps 85, 86 are formed by parts of the covering walls 89, 90, facing one another and connected releasably to one another, of the parts packs (half-cartons 34, 35). For this purpose, the insertion flaps 85 and 86 are formed by means of appropriate respective stampings 91 and 92 int he blank zone 93 for the covering walls 89 and 90. Consequently, the insertion flaps 85 and 86 also function as part of the severing line 94 which is formed between the covering walls 89 and 90 in the way already described. Residual connections 95 are formed, here, in the severing line 94, that is to say in the region between the insertion flaps 85 and 86. As a result, to divide the cigarette carton so as to form the half-carton 34, 35, the procedure is the same as in the exemplary embodiment according to FIG. 1 and the following Figures, that is to say breaking against one another the spread-out half-cartons 34, 35 extending in the same plane.

Figure 19:
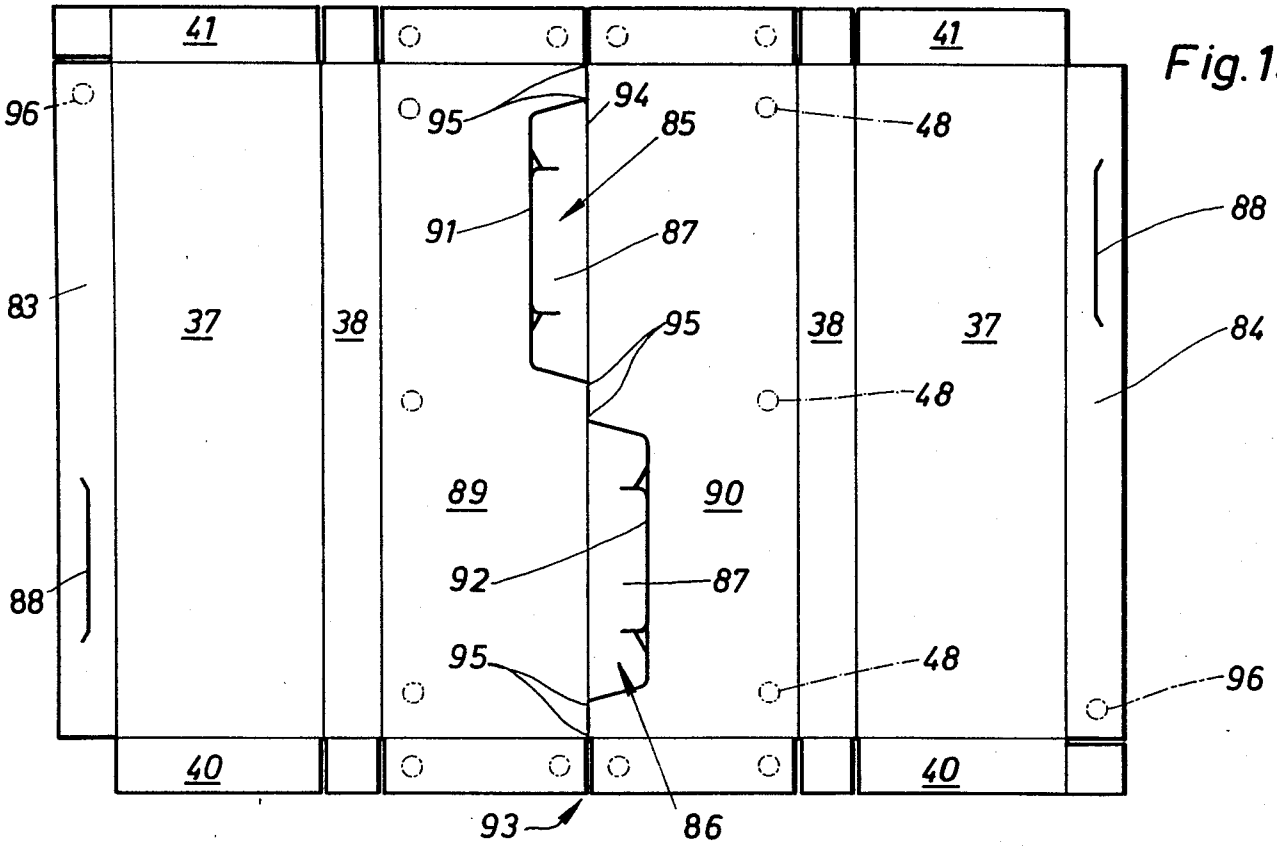
FIG. 19 shows a spread-out blank for a package according to FIGS 16 to 18.
Figure 20:
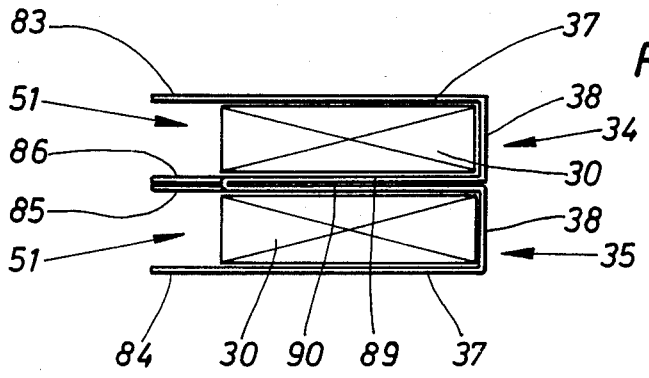
FIG. 20 shows, in an end view, a phase during the production of a package from a blank according to FIG. 19.
Figure 21:
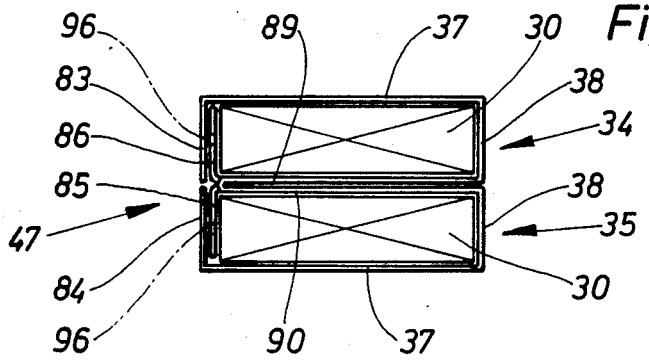
FIG. 21 shows, in an end view, a finished pack (cigarette carton) related to the exemplary embodiment according to FIGS. 16 to 20.
Figure 22:
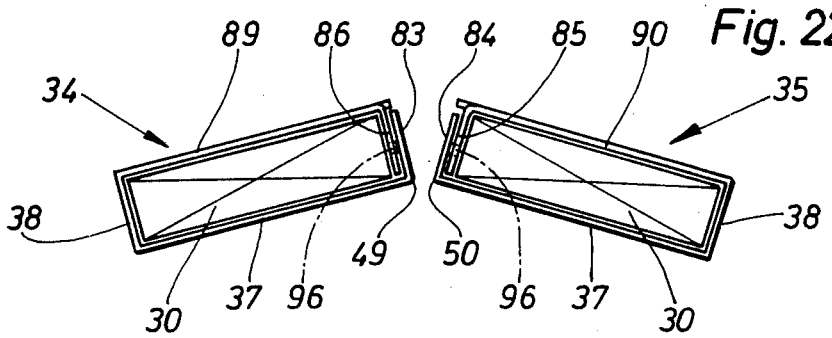
FIG. 22 shows a severed package of the exemplary embodiment according to FIG. 19 which consists of two part packs.

When a package (cigarette carton) is produced from a blank according to FIG. 19, according to the present exemplary embodiment the procedure is such that the completely stamped-out insertion tongues 87 are aligned with the covering walls 89 and 90 so as to project transversely, that is to say as a prolongation of the latter when these are folded in between the rows of packs 31, 32, so as to rest against one another, by being folded over 180° (FIG. 20). Accordingly, the insertion claps 85, 86 extend transversely relative to the common side face 47 of the package. The insertion flaps 85, 86 are then folded over against the end faces 51 of the cigarette packs 30. The longitudinal side walls 83 and 84 initially projecting at the top and bottom (FIG. 20) are then folded, in turn, against these end faces. The longitudinal side walls are each provided with a glue spot 96 which forms a (releasable) connection between the longitudinal side walls 83, 84 and the associated insertion flaps 85, 86.

When the cigarette carton formed in this way is divided, the glue points 48 are first broken and the half-cartons 34, 35 pivoted into a common plane. It is then severed in the way described in the region of the severing line 94, the residual connections 95 being severed at the same time.

To enable each part pack (half-carton 34, 35) to be used, the glue spots 96 can now be broken, so that the connection between the longitudinal side walls 83, 84 and the associated insertion flaps 85, 86 is removed. The lattter can now be introduced by means of the insertion tongue 87 into the retaining slit 88 in the longitudinal side wall 83, 84, so that a reclosable half-carton 34, 35 is provided.

Figure 23:
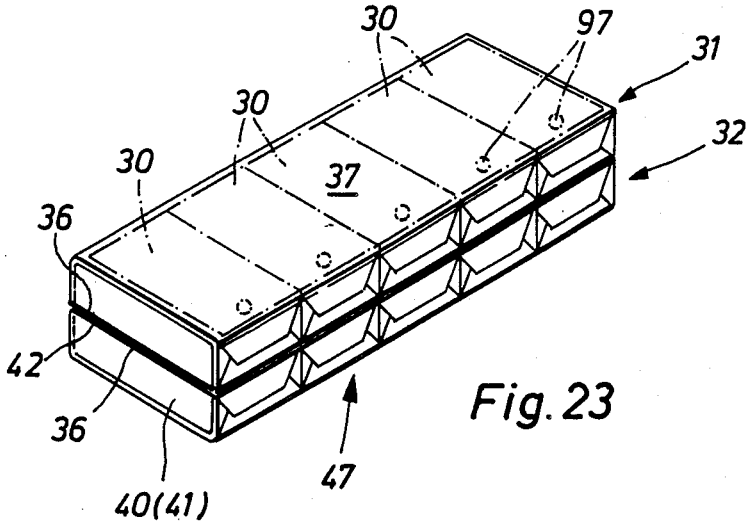
FIG. 23 shows, in perspective, an exemplary embodiment of the pack similar to that according to FIG. 1 to 3, but with open longitudinal side.
Figure 24:
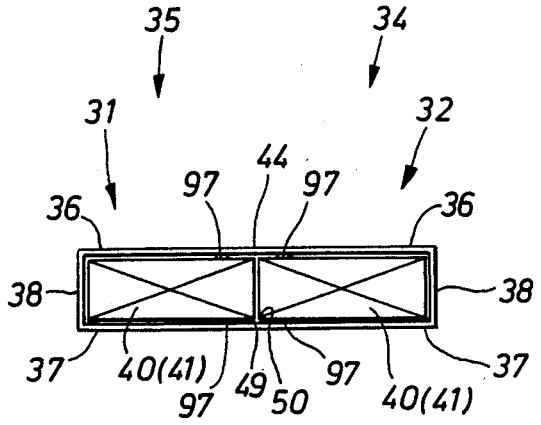
FIG. 24 shows the pack according to FIG. 23 in cross-section, with the part packs spread out.
Figure 25:
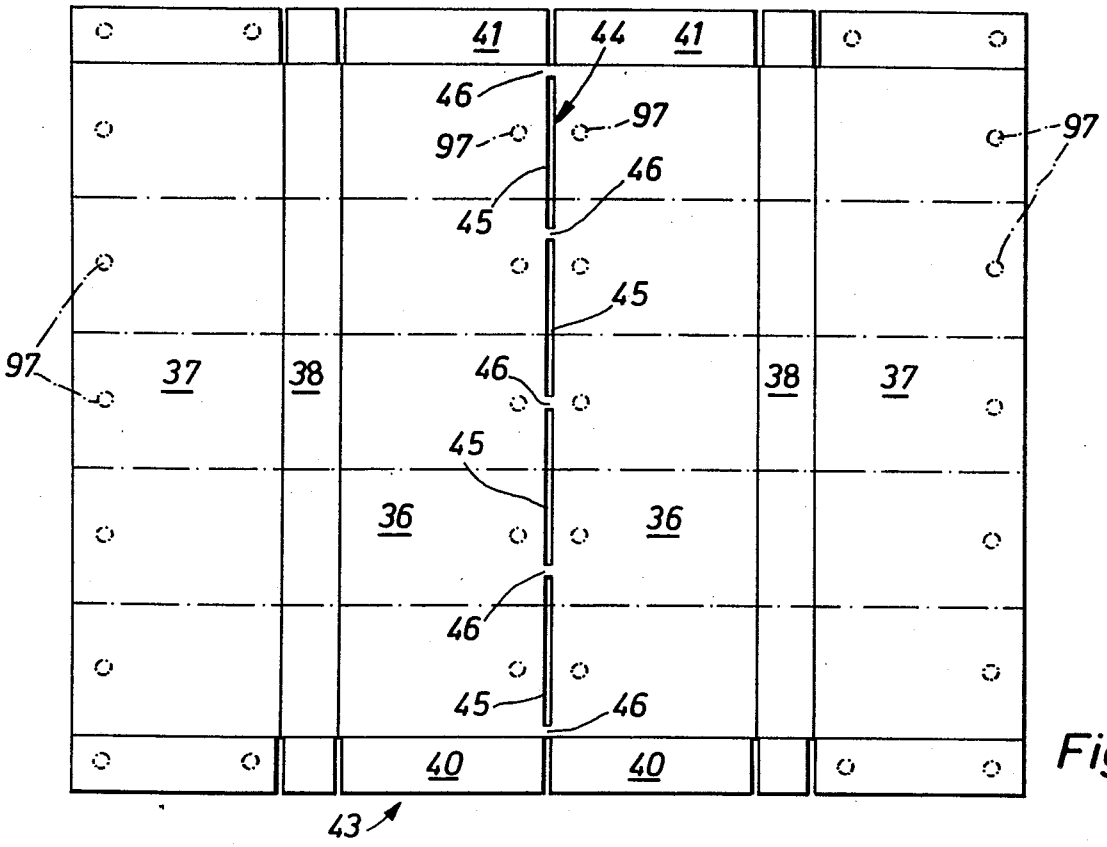
FIG. 25 shows a spread-out blank for producing a pack according to FIGS. 23 and 24.

The pack accoprding to FIG. 23 to FIG. 25 is especially suitable for uses in which measures are subsequently to be taken on the end faces of the cigarette packs 30, and in which, in particular, revenue markings are to be applied. In this exemplary embodiment, the longitudinal side walls 39 adjacent to the severing line 44 are omitted, so that the two half-cartons 34 and 35 are open in the region of these longitudinal sides. The end faces of the cigarette packs 30 are exposed here.

To fix the cigarette packs 30 in the open half-cartons 34, 35, each cigarette pack 30 is connected releasably to one of the walls of the half-cartons 34, 35 especially to the two covering walls 36, 37. In the present case, a glue spot 97 is provided on each covering wall for each cigarette pack 30 to enable it to be fixed in the half-carton 34, 35.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirits of the present invention. Accordingly, the foregoing detailed description should be construed as exemplary in nature and not as limiting to the scope and spirit of the invention as set forth in the appended claims.

What is claimed is:

1. A package for receiving a plurality of cigarette packs comprising:

two discrete partial packages, each discrete partial package having first and second oppositely positioned covering walls, the first covering wall of one discrete partial package being connected to the first covering wall of the other discrete partial package along a severing line so that the two discrete partial packages are separable from each other along the severing line;

each discrete partial package being adapted to contain a row of adjacent cigarette packages;

the first covering wall of the one discrete partial package having an outer surface and the first covering wall of the other discrete partial package having an outer surface, the outer surface of the first covering wall of the one discrete partial package facing the outer surface of the first covering wall of the other discrete partial package and the first covering wall of the one discrete partial package being adapted to be releasably connected to the first covering wall of the other discrete partial package by means of a plurality of spaced glue points that are positioned betweent he facing outer surfaces of the one discrete partial package and the other discrete partial package;

said severing line including a severing cut and a plurality of material connection points positioned along the severing line for connecting the first covering wall of the one discrete partial package to the first covering wall of the other discrete partial package;

a closing tab extending laterally from the second covering wall of each discrete partial package, the closing tab extending from the one discrete partial package including a longitudinal side wall attached to the second covering wall of the one discrete partial package and a connecting edge strip attached to that longitudinal side wall, the closing tab extending from the other discrete partial package including a longitudinal side wall attached to the second covering wall of the other discrete partial package and a connecting edge strip attached to that longitudinal side wall, the connecting edge strip of the closing tap extending from the second covering wall of the one discrete partial package overlapping the connecting edge strip of the closing tab extending from the second covering wall of the other discrete partial package to thereby define an intermediate closure position, said connecting edge strips being foldable inwardly from the intermediate position to a position wherein the connecting edge strip of the closing tab that extends from the second covering wall of the one discrete partial package overlaps a portion of the first covering wall of the one discrete partial package and the connecting edge strip of the closing tab that extends from the second covering wall of the other discrete partial package overlaps a portion of the first covering wall of the other discrete partial package.

2. A package according to claim 1, wherein the two discrete partial packages are formed from a common blank, a portion of the blank being adapted to enclose each row of cigarette packs.

3. A package according to claim 1, wherein each of said two discrete partial packages has end walls extending from said first and second covering walls at one end of the discrete partial packages and each of said two discrete partial packages has end walls extending from said first and second covering walls at an opposite end of the discrete partial packages.

4. A package according to claim 1, and further comprising a plurality of severing cuts spaced along the severing line and positioned between the material connection points.

5. A package according to claim 1, wherein one of said connecting edge strips includes a plurality of spaced glue points for releasably connecting the overlapping portions of the connecting edge strips.

* * * * *

UNITED STATES PATENT AND TRADEMARK OFFICE

CERTIFICATE OF CORRECTION

PATENT NO. : 4,932,534

DATED : June 12, 1990

INVENTOR(S) : Heinz FOCKE et al

It is certified that error appears in the above-identified patent and that said Letters Patent is hereby corrected as shown below:

In the Claims:

In claim 1, column 7, line 6, amend "betweent he" to --between the--; and line 27, amend "tap" to --tab--.

Signed and Sealed this

Thirty-first Day of December, 1991

*Attest:*

HARRY F. MANBECK, JR.

*Attesting Officer*

*Commissioner of Patents and Trademarks*